US005551456A

United States Patent [19]

Hartel

[11] Patent Number: 5,551,456

[45] Date of Patent: Sep. 3, 1996

[54] MASCARA BRUSH CONSTRUCTION

[75] Inventor: Franklin J. Hartel, Palmer, Mass.

[73] Assignee: Sanderson-Macleod, Inc., Palmer, Mass.

[21] Appl. No.: 333,751

[22] Filed: Nov. 3, 1994

[51] Int. Cl.[6] ..... A45D 40/26

[52] U.S. Cl. ..... 132/218; 132/320; 15/207; 15/207.2

[58] Field of Search ..... 132/218, 217, 132/216, 317, 320; 15/206, 207, 207.2, DIG. 5

[56] References Cited

U.S. PATENT DOCUMENTS

| | | | |
|---|---|---|---|
| 4,861,179 | 8/1989 | Schrepf et al. | 132/218 |
| 4,898,193 | 2/1990 | Gueret | 15/206 |
| 5,133,590 | 7/1992 | Fitjer | 15/206 |
| 5,238,011 | 8/1993 | Gueret | 132/218 |
| 5,335,465 | 8/1994 | Gueret | 132/218 |
| 5,357,987 | 10/1994 | Schreph | 132/218 |

FOREIGN PATENT DOCUMENTS

| | | | |
|---|---|---|---|
| 2170996 | 8/1986 | United Kingdom | 132/218 |

*Primary Examiner*—John G. Weiss

*Attorney, Agent, or Firm*—John J. Dempsey; Chapin, Neal & Dempsey, P.C.

[57] ABSTRACT

An applicator brush for fluid-type cosmetics, such as may be used in applying mascara to eyelashes which includes a bristle portion disposed at one end of a helical twisted wire core with a handle disposed at the outer end. The configuration of the bristle portion is such that the bristle tips define a generally cylindrical outer surface having two (2) diametrically opposed channels and application surfaces helically disposed along the length of the brush portion which are spiraled about the core to form a helix thereof. The brush portion is formed by disposing the bristles between the lengths of the wire and helically twisting the wire to form the core that retains the bristles therebetween. The bristle portion is then trimmed to a shape of generally rectangular cross-section. To form the helical application surface, the wire core is further twisted in the same direction a predetermined number of turns.

3 Claims, 3 Drawing Sheets

MASCARA BRUSH CONSTRUCTION

FIELD OF THE INVENTION

This invention relates to brushes for fluid-type cosmetics, and more particularly to mascara brushes that include a bristle block formed by discrete filaments secured by a twisted wire core and having an overall helical configuration.

BACKGROUND OF THE INVENTION

Although there are many types of mascara brushes, in recent years, the most common construction has been the type in which the bristles are secured by a twisted wire core. In a break through advance of a few years ago, the Hartel, et al, U.S. Pat. No. 4,744,425 disclosed and claimed a brush construction which overcame one of the shortcomings of such twisted wire brushes resulting from the tendency of the individual brush filaments to follow the spiral pattern of the twisted wire core. Previously, that construction had left voids or gaps between adjacent convolutions of bristles whereby the mascara product had a tendency to gather and clump therein. The solution found by the inventors Hartel and Sanderson was to provide filaments which were tubular or hollow in cross-section or noncircular so that when such filaments were clamped between the wire turns of the core, the filaments were crimped so as to flare omnidirectionally outward with the result that the filament tips were uniformly distributed. Brushes made and sold by SANDERSON MACLEOD, INC., the assignee of said inventors, and licensees thereof, enjoyed great commercial success.

After the bristle block or head of the mascara brush is formed, the bristles are typically finished by trimming the bristle block to any desirable configuration, such as a cylindrical, conical, polygonal or combinations thereof. Because of the high costs associated with trimming such brush heads, it has not been common practice to produce such brushes in any complex or intricate configurations despite the fact a rectangular brush pattern is considered advantageous in the application of mascara.

Mascara brushes of the type embodying this invention are usually sold to the public as part of a complete mascara package which includes a fluid-type cosmetic disposed therein. The brush extends from a cap and applicator handle and the container typically includes, at its upper end, a diaphragm disposed therein. The diaphragm has a centrally disposed orifice adapted to enable the mascara brush head to pass therethrough to pick up a supply of mascara and to wipe "off" any excess thereof as the brush is withdrawn from the container. The diameter of the orifice is thus made slightly smaller than the outer diameter of the brush head so that when it is withdrawn from the container, the bristles will, in effect, be deflected to ring "out" or squeegee "off" excess fluid from the brush head. The controlled quantity of fluid usually retained by conventional mascara brushes of generally uniform cross-section usually have required numerous reinsertions of the brush into the mascara container to pick up additional mascara.

Many different solutions have been used to overcome the problems of mascara application involving the dual problems of mascara pick up combined with a combing action for uniform application to the eyelashes. In this connection, various combinations of stiffer and softer bristles have been used with some success as has the so-called hollow fiber brush. Nonetheless, the cosmetics' industry is always searching for more effective solutions to the problems of mascara brush performance in a low-cost brush construction.

SUMMARY OF THE INVENTION

Accordingly, it is the primary object of the present invention to provide an improved mascara brush that economically overcomes the drawbacks of the prior art.

It is another object to provide a mascara brush head that, in effect, is shaped to provide a reservoir for the pick up of a fluid-type mascara and which is adapted for ease of application and combing action by the simple expedient of rotating the brush.

It is a further object to provide an improved method for the economical method of manufacturing such improved mascara brushes.

According to the present invention, an applicator brush for fluid-type cosmetics includes a plurality of discrete bristles secured by a twisted wire core and which extend radially from the core. The radially extending bristles are then trimmed to form a polygonal shape of generally rectangular cross-section over a substantial portion of the length of the bristle block of the brush. Thereupon, the wire core is twisted sufficiently to impart a helical twist to the rectangular bristle block along the length thereof.

The above and other objects and advantages of this invention will become more readily apparent when the following description is read in conjunction with the accompanying drawings.

DETAILED DESCRIPTION OF THE PREFERRED EMBODIMENTS

Figure 5:
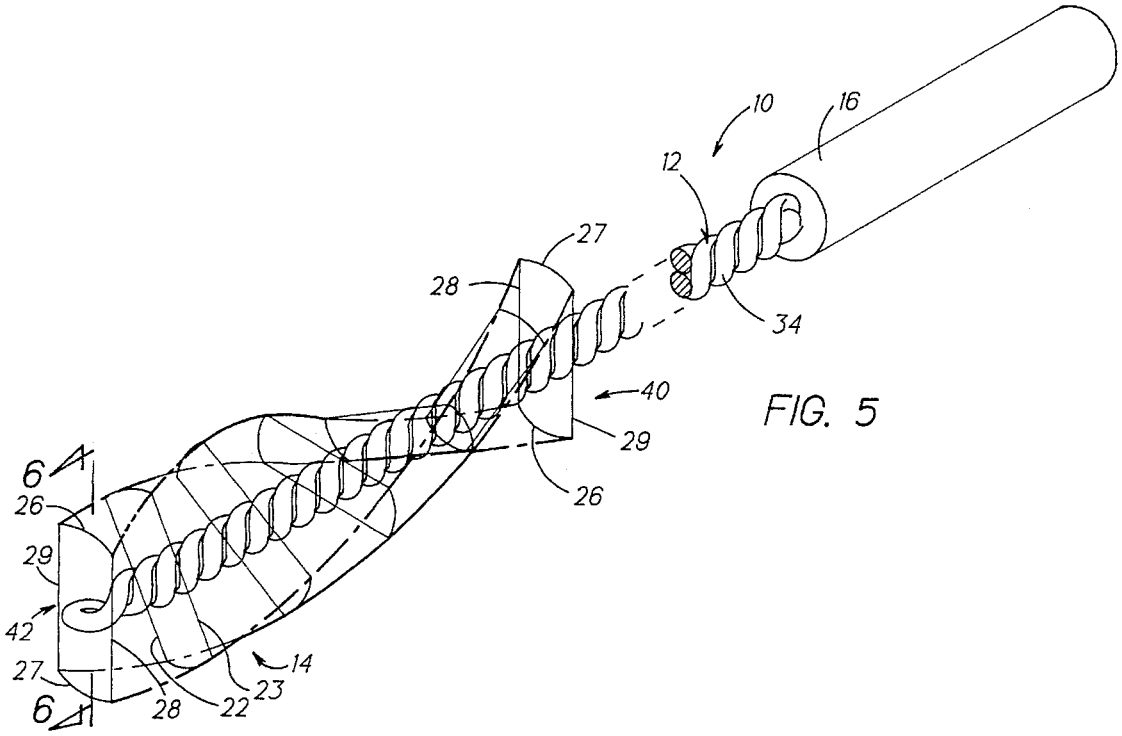
FIG. 5 is a perspective view of the envelope of the preferred embodiment of the present invention.

A cosmetic applicator or mascara brush 10, as depicted in FIG. 5, is shown having a helical metallic wire core 12, a bristle block or head portion 14, and a handle 16 fitted onto the free, or terminal end, portions of the twisted wire core 12. The handle may also serve as a closure or cap for a mascara container (not shown). The bristle block or head portion 14 of the brush 10 is formed of a plurality of discrete bristles 20 (FIG. 1), each having an overall length a which is approximately twice the radial dimension of the bristle block 14. The bristles 20 may be solid or hollow in cross-section and the outer surface of the filaments may be of circular or noncircular in cross-section.

Figure 1:
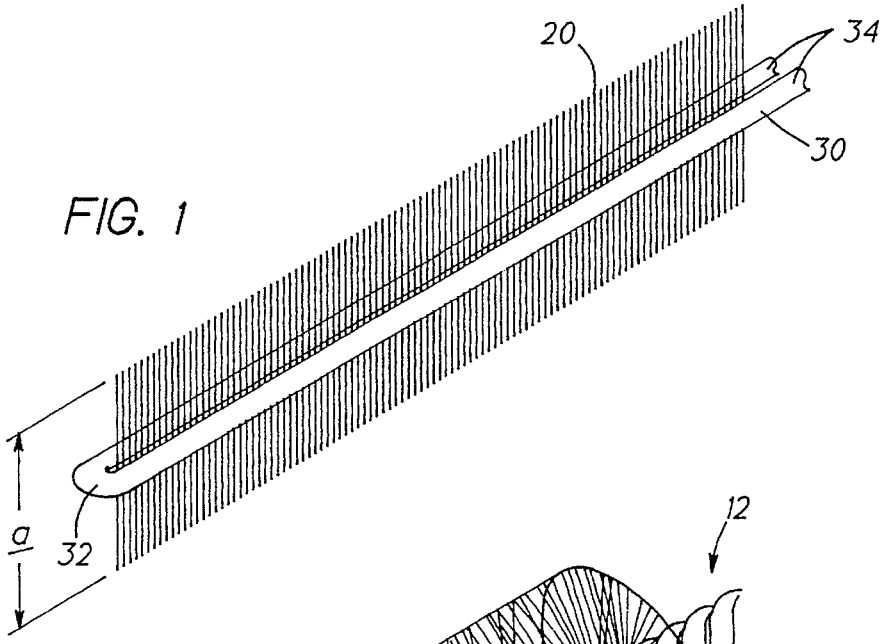
FIG. 1 is an elevational view of one step in the process of manufacturing brushes of the type embodying this invention.
Figure 2:
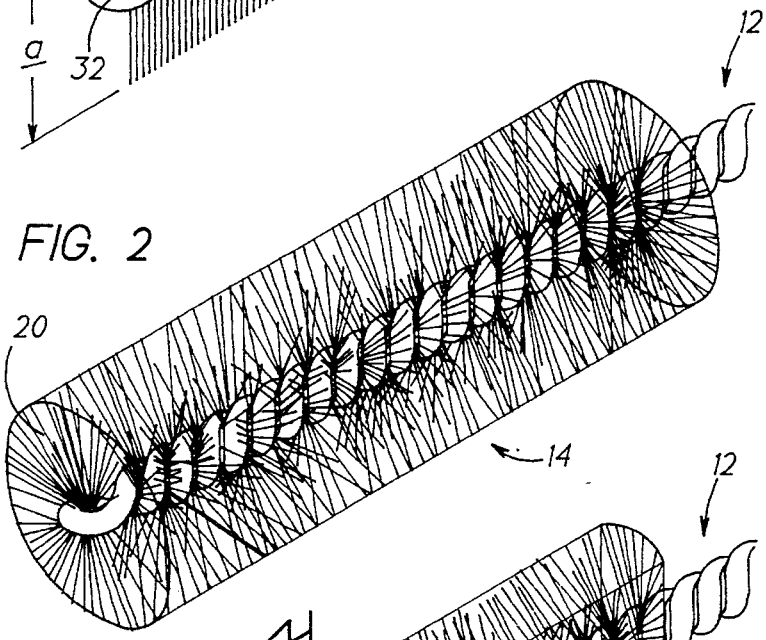
FIGS. 2 and 3 are perspective views of two further steps in the process of manufacturing brushes of the type embodying this invention.

The brush 10 may be fabricated in the customary manner by using a pliable metallic wire 30, reversibly folded back upon itself, as depicted at 32 in FIG. 1. A plurality of bristles 20 of predetermined length a are placed between the two coextensive leg portions 34 of the wire 30. The wire 30 is then twisted to form the core 12 of helical configuration, as shown in FIG. 2, which grips the bristles 20 at the midpoint of their length, causing the filaments to be crimped and folded in half. The outer tips of the bristles 20 define a roughly cylindrical bristle surface and may then be trimmed to a more uniform cylindrical shape of a predetermined diameter, as shown in FIG. 2, or conical shape.

Figure 3:
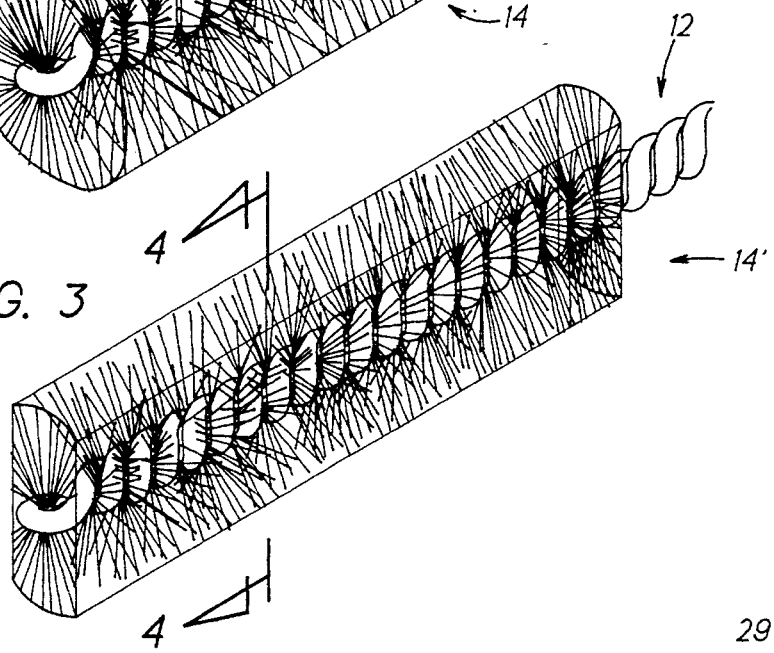

In accordance with this invention, the cylindrical bristle block is then trimmed on opposite sides to provide two (2) generally parallel planar portions whereby a rectangular bristle shape 14', as shown in FIG. 3, is obtained. Thereafter, an overall helical configuration is imparted to this rectangular bristle shape 14' by a further twist being applied to the wire core 12 so that the bristle block, per se, is twisted longitudinally and is thereby given a spiral or helical configuration, as at 14 in FIG. 5. The amount of twist may range anywhere from 90° to 360° or from ¼ to a full-twist, wherein, as illustrated in FIG. 5, the brush is shown having a half-twist.

It should be recognized that the brush portion 14' may be trimmed into other shapes prior to twisting the core 12 to impart to the bristle block in a helical configuration. For example, the cross-sectional shape may be generally cruciformed to form a cylindrical head portion having four (4) V-shaped channels that spiral about the longitudinal axis of the core.

Figure 4:
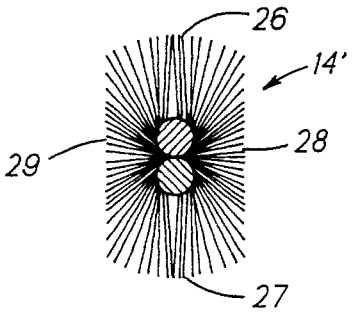
FIG. 4 is a cross-sectional view of the brush head taken along line 4—4 of FIG. 3.

FIG. 5 illustrates the envelope of the head portion 14 of the brush 10 which depicts the outer surfaces formed by the tips of the bristles 20 (FIG. 2). The bristle portion 14' has a generally rectangular cross-section, as shown in FIG. 4, having rounded upper and lower surfaces or lands 26 and 27 and two (2) planar or flat side surfaces 28 and 29. The two (2) rounded surfaces or lands form the application and combing surfaces of the brush portion 14, while the two (2) diametrically opposed helical trenches or channels 22 and 23, formed by the two (2) planar surfaces 26 and 27, in effect, serve as reservoirs for picking up and retaining the mascara for easier application to the eyelashes. Also, as shown in FIG. 5, the rectangular cross-section of bristles 20 (FIG. 2) spirals longitudinally about the core wire 12 approximately 180°. The upper surface 26 of the outer end 42, rotates counterclockwise 180° such that the upper surface becomes the lower surface of the inner end 40 of the brush portion. The lower surface 27 of the outer end 42 of the bristle portion also spirals counterclockwise 180° such that it becomes the upper surface of the inner end 40 thereof.

Figure 6:
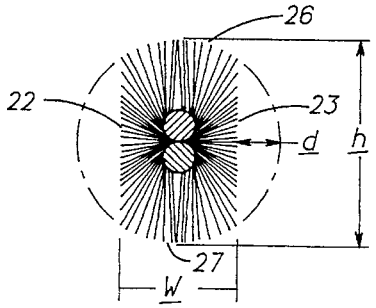
FIG. 6 is a cross-sectional view of the mascara brush head of the preferred embodiment of the present invention taken along line 6—6 of FIG. 5.

The depth d of the channels 22 and 23 is defined by one-half the difference between the width w and the height h of the rectangular cross-section in FIG. 6. In the preferred embodiment shown in FIG. 5, the width of the rectangular cross-section is approximately one-half the height thereof.

Figure 7:
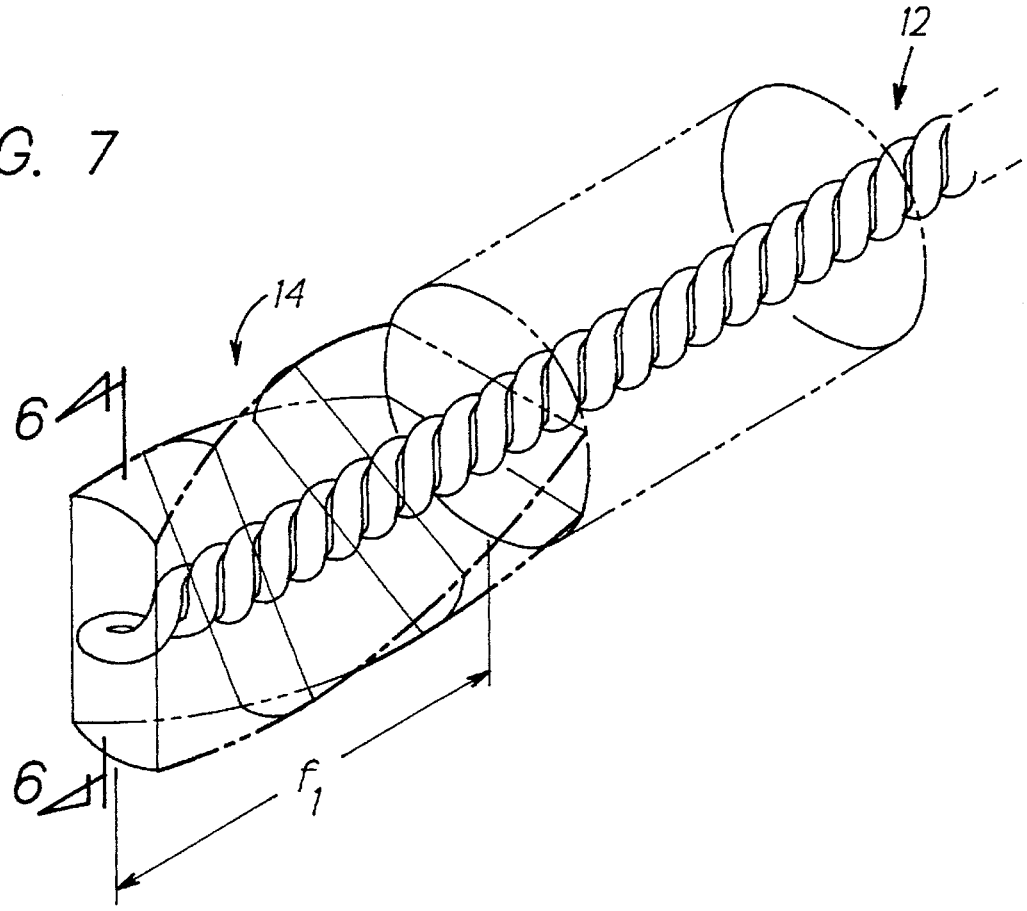
FIG. 7 is a perspective view of the envelope provided in an alternative embodiment of the present invention.

In an alternative embodiment of the brush 10 as shown in FIG. 7, the diametrically opposed channels 22 and 23 extend a predetermined distance along the longitudinal axis with the brush head remaining cylindrically shaped. To fabricate such a brush portion 14, a generally rectangular shape is trimmed along the longitudinal axis the predetermined distance. When the wire core 12 is then further twisted, the rectangular portion spirals about the core to form a helix, while the cylinder portion remains cylindrical.

The short bristles that define the channels 22 and 23 are adapted to retain and provide additional mascara to the longer bristles that define the application surfaces 26 and 27 of the brush portion 14 during application of said mascara to one's eyelashes. Typically, a mascara container (not shown) has a diaphragm disposed therein having an orifice centrally disposed. The diameter of said orifice is smaller than the outer diameter h of the bristle portion 14 of the brush 10. When the eyelash brush is withdrawn from the mascara container through the diaphragm, excess mascara is wiped from the longer bristles of the brush so that the shorter bristles, which define the lower surfaces of the channels 22 and 23, will not be affected as much by the squeegee action of the diaphragm thereof. In addition, the tips of the shorter bristles are more densely related per unit area to enable them to better retain the mascara than the longer bristles 20. Moreover, the spiral or helical twist of each channel also contributes to the retention of the mascara along the bristle block 14 because this contour acts to impede the unrestricted straight line gravity flow from the helical reservoirs 22 and 23. As the mascara from the longer bristles is applied, the mascara from the shorter bristles is drawn to the longer bristles as the brush is rotated during application of the mascara.

The helical configuration of the bristle portion 14 provides smooth, continuous application of mascara and combing action of the eyelashes. An application surface sequentially contacts the eyelashes, applying mascara from end-to-end of the lashes by axial rotation of the brush.

Although the invention has been shown and described with respect to an exemplary embodiment thereof, it should be understood by those skilled in the art that the foregoing and various other changes, omissions, and additions in the form and detail thereof may be made therein without departing from the spirit and scope of the invention.

Having thus described my invention, what is claimed is:

1. An applicator brush for mascara comprising in combination, a twisted wire core, a bristle block of radially extending bristles secured to the twisted wire core, said bristles being initially trimmed along at least a substantial portion of its length to provide a bristle block having tip portions of said bristles defining a portion of the length of said brush of generally rectangular cross-section including a pair of longer, opposed, parallel sides and shorter sides, the bristles forming the shorter sides being at a substantially greater radial distance from the twisted wire core than the longer, opposed sides, said core being further twisted so that said shorter sides define opposed helically shaped lands and said longer sides define helically shaped channels therebetween.

2. An applicator brush for mascara, as set forth in claim 1, and in which said bristles are initially trimmed along opposite sides to provide said bristle block in which the longer, opposed, sides are defined by said bristle tip portions are generally planar and parallel to each other and the shorter opposed sides thereof include outer surfaces defined by said bristle tips which are arcuate so as to provide said opposed helically shaded lands that curve both in the radial and in the axial directions.

3. An applicator brush for mascara, as set forth in claim 1, wherein said further twisting is carried out along only said rectangular portion of the bristle block whereby said brush includes a generally cylindrical portion, as well as the land and helical channel portion.

* * * * *